US006705288B2

(12) United States Patent
Inoue et al.

(10) Patent No.: US 6,705,288 B2
(45) Date of Patent: Mar. 16, 2004

(54) STARTING CONTROL APPARATUS FOR INTERNAL COMBUSTION ENGINE

(75) Inventors: Hitoshi Inoue, Tokyo (JP); Hideaki Tani, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 91 days.

(21) Appl. No.: 10/134,613

(22) Filed: Apr. 30, 2002

(65) Prior Publication Data

US 2003/0079722 A1 May 1, 2003

(30) Foreign Application Priority Data

Oct. 29, 2001 (JP) ..... 2001-330591

(51) Int. Cl.[7] ..... F02P 5/00
(52) U.S. Cl. ..... 123/406.47; 123/491; 123/406.53
(58) Field of Search ..... 123/491, 406.47, 123/406.53

(56) References Cited

U.S. PATENT DOCUMENTS 5,735,241 A * 4/1998 Matsuura ..... 123/305
5,881,694 A * 3/1999 Nakada ..... 123/305
6,336,355 B1 * 1/2002 Sasaki et al. ..... 73/35.08

FOREIGN PATENT DOCUMENTS

JP 11-343914 12/1999
JP 2000-291469 10/2000

* cited by examiner

*Primary Examiner*—Hieu T. Vo
*Assistant Examiner*—Hai Huynh
(74) *Attorney, Agent, or Firm*—Sughrue Mion, PLLC

(57) ABSTRACT

A starting control apparatus for an internal combustion engine capable of ensuring proper starting performance with a fuel injection quantity of a lean air-fuel ratio while reducing HC discharge quantity in an engine start phase with high reliability. During a period from the start of cranking to occurrence of complete explosion in the engine starting phase, the fuel injection quantity charged to individual cylinders on a cylinder-by-cylinder basis and the ignition timing for igniting the fuel are properly set for each of the individual combustion strokes taking place sequentially among plural cylinders. An optimal combination of the fuel injection quantity and the ignition timing is realized for thereby producing required torque just enough in the individual combustion strokes.

6 Claims, 6 Drawing Sheets

FIG. 3

| COMBUSTION STROKE NUMBER COUNTER VALUE CNT | 0 | 1 | 2 | 3 | 4 | 5 | ····· | 50 |
|---|---|---|---|---|---|---|---|---|
| FUEL INJECTION QUANTITY (mcc) | 200 | 205 | 205 | 209 | 209 | 210 | ····· | 250 |

FIG. 4

| COMBUSTION STROKE NUMBER COUNTER VALUE CNT | 0 | 1 | 2 | 3 | 4 | 5 | ····· | 50 |
|---|---|---|---|---|---|---|---|---|
| IGNITION TIMING (BTDC · [°CA]) | 25 | 25 | 25 | 25 | 27 | 28 | ····· | 15 |

| ENGINE ROTATION SPEED CHANGE RATE ΔNe (r/min) | 0 | 10 | 20 | 30 | 40 | 60 | 80 | ··· | 500 |
|---|---|---|---|---|---|---|---|---|---|
| IGNITION TIMING CORRECTING QUANTITY [°CA] | 0 | +10 | +10 | +9 | +8 | +7 | +6 | ··· | 0 |

STARTING CONTROL APPARATUS FOR INTERNAL COMBUSTION ENGINE

BACKGROUND OF THE INVENTION

1. Field of the Invention

The present invention generally relates to an apparatus for controlling operation for starting an internal combustion engine such as typified by the engine for an automobile or a motor vehicle or the like. More particularly, the present invention is concerned with an engine starting control apparatus which can ensure a proper starting performance for the internal combustion engine with a fuel injection quantity of a lean air-fuel ratio while reducing positively and significantly a discharge quantity of hydrocarbons (HC) and others upon starting of the operation of the internal combustion engine.

2. Description of Related Art

In general, in the internal combustion engine for a motor vehicle equipped with a fuel injection system and an ignition system which are of electrically or electronically controlled type, cranking operation is carried out by using an electric starter motor in an engine starting phase until complete explosion has been brought about to enable the electronic control of the fuel injection and the ignition on a cylinder-by-cylinder basis. In the course of the cranking operation, the fuel injection quantity and the ignition timing are set to respective predetermined values in dependence on the engine rotation number or speed (rpm) detected after the cranking has been initiated.

In that case, it is desired or required to ensure appropriate starting performance for the internal combustion engine while rendering the exhaust gas components to be favorable by reducing or suppressing the discharge quantity of hydrocarbons and others (hereinafter also referred to simply as the HC discharge quantity).

By way of example, in the starting control apparatus for the internal combustion engine described in Japanese Patent Application Laid-Open Publication No. 343914/1999 (JP-A-11-343914), the fuel injection control for the individual cylinders of the internal combustion engine in the engine starting phase is carried out during the suction stroke, wherein when the engine rotation number or speed (rpm) increases excessively, the ignition timing is correctively retarded to thereby lower the engine rotation speed (rpm).

More specifically, in the engine starting phase, the time duration for which the intake valve is held open (i.e., suction stroke) is set relatively long for allowing the fuel required for the combustion to flow into the combustion chamber defined internally of the cylinder so that even in the case where the engine starting operation is performed at a low temperature, the air-fuel ratio of the air-fuel mixture can be set to a value lying within a range in which combustion of the air-fuel mixture can occur without fail. In this way, the HC discharge quantity can be reduced in the engine starting phase.

However, in the hitherto known engine starting control apparatus such as disclosed in the publication cited above, the quantity of fuel charged at the predetermined ignition timing is set to a predetermined value as required until the complete explosion takes place. In other words, concentration of the fuel of the air-fuel mixture as injected is not always set to a necessary minimum value. Consequently, the intended object (i.e., suppressing the HC discharge quantity to a possible minimum in the engine starting phase) unfortunately remains to be achieved satisfactorily. In other words, the conventional technique such as disclosed in the above-mentioned publication does not always represent practically effective resolution for reducing the HC discharge quantity in the engine starting phase.

As is apparent from the above, in the conventional engine starting control apparatus such as typified by the one disclosed in Japanese Patent Application Laid-Open Publication No. 343914/1999, the fuel injection quantity and the ignition timing are set or maintained at respective predetermined values upon starting of the cranking operation in dependence on the engine rotation speed detected after the start of the cranking operation until it is decided that the complete explosion can be brought about. In other words, the fuel is injected in a sufficient quantity capable of triggering the complete explosion.

To say in another way, a same quantity of fuel is supplied at a same ignition timing to all the individual cylinders of the engine in which combustion takes place sequentially over a time period from the initial explosion up to the complete explosion. Such being the circumstances, there arises a problem that the air-fuel mixture may unwantedly be charged with an unnecessarily rich air-fuel ratio (i.e., with a high fuel concentration) until the output torque capable of triggering the complete explosion is made available, rendering it practically impossible to suppress or reduce the HC discharge quantity with high reliability in the engine starting phase.

SUMMARY OF THE INVENTION

In the light of the state of the art described above, it is an object of the present invention to provide a starting control apparatus for an internal combustion engine which apparatus is capable of ensuring proper or improved starting performance with a fuel injection at a lean air-fuel ratio while reducing positively the HC discharge quantity in the engine starting phase with enhanced reliability.

In view of the above and other objects which will become apparent as the description proceeds, there is provided according to a general aspect of the present invention a starting control apparatus for an internal combustion engine including an intake pipe for supplying an air-fuel mixture containing air and a fuel to the engine having a plurality of cylinders, a throttle valve mounted internally of the intake pipe for adjusting flow rate of intake air fed to the engine, a fuel injection valve for charging the fuel into the cylinder of the engine, a spark plug provided in association with each of the plural cylinders of the engine for igniting the air-fuel mixture charged into the cylinder, various types of sensors for detecting operating state of the engine, and a control unit for controlling the fuel injection valve and the spark plug in dependence on the operating state of the engine upon starting of operation thereof. The control unit is comprised of a combustion stroke discriminating means for discriminatively identifying combustion strokes taking place sequentially among the plural cylinders, wherein the fuel injection quantity supplied to the individual cylinders of the engine and the ignition timing for burning the charged fuel are set variably for the individual combustion strokes, respectively, upon starting of operation of the engine.

In a preferred mode for carrying out the invention, the control unit may include a counter for counting the number of the combustion strokes taking place sequentially among a plurality of cylinders from a time point at which cranking is started upon starting of operation of the internal combustion engine, wherein the fuel injection quantity and the ignition timing for each of the cylinders may be set on the basis of the number of the combustion strokes.

In another preferred mode for carrying out the invention, the control unit may include a storage for storing control quantity map data bearing correspondency to the fuel injection quantity and the ignition timing, respectively, with the number of the combustion strokes being used as parameter with a view to setting the fuel injection quantity and the ignition timing by looking up the control quantity map data, wherein the map data value for the fuel injection quantity may be set variably so that the control quantity increases or alternatively decreases in dependence on increase of the number of the combustion strokes.

By virtue of the arrangements described above, appropriate or proper engine starting performance can be realized with the fuel quantity of a lean air-fuel ratio while reducing positively the HC discharge quantity in the engine starting phase.

In yet another mode for carrying out the invention, the various types of sensors mentioned previously should preferably include a water temperature sensor for detecting cooling water temperature of the internal combustion engine, wherein the control unit should preferably be so designed as to set the fuel injection quantity and the ignition timing on the basis of the cooling water temperature.

In still another mode for carrying out the invention, the various types of sensors mentioned above should preferably include a rotation sensor for detecting a rotation number (rpm) of the engine, wherein the control unit should preferably be so designed as to set a correcting quantity for the ignition timing in dependence on the rotation number of the engine.

In a further mode for carrying out the invention, the control unit should preferably include a storage for storing correcting quantity map data bearing correspondency to the control quantity for the ignition timing as a function of change of rotation number of the engine, wherein the control unit should preferably be so designed as to set a correcting quantity for the ignition timing by looking up the correcting quantity map data to thereby set finally the ignition timing determined by adding or subtracting the correcting quantity to or from a reference value of the ignition timing.

With the arrangements described above, the engine starting performance as well as the exhaust gas quality can further be improved in the engine starting phase.

The above and other objects, features and attendant advantages of the present invention will more easily be understood by reading the following description of the preferred embodiments thereof taken, only by way of example, in conjunction with the accompanying drawings.

BRIEF DESCRIPTION OF THE DRAWINGS

In the course of the description which follows, reference is made to the drawings, in which:

FIG. 3 is a view for illustrating map data of fuel injection quantity set for the engine in the starting control apparatus according to the first embodiment of the invention;

FIG. 4 is a view for illustrating map data of ignition timing set for the engine in the starting control apparatus according to the first embodiment of the invention;

DESCRIPTION OF THE PREFERRED EMBODIMENTS

Figure 1:
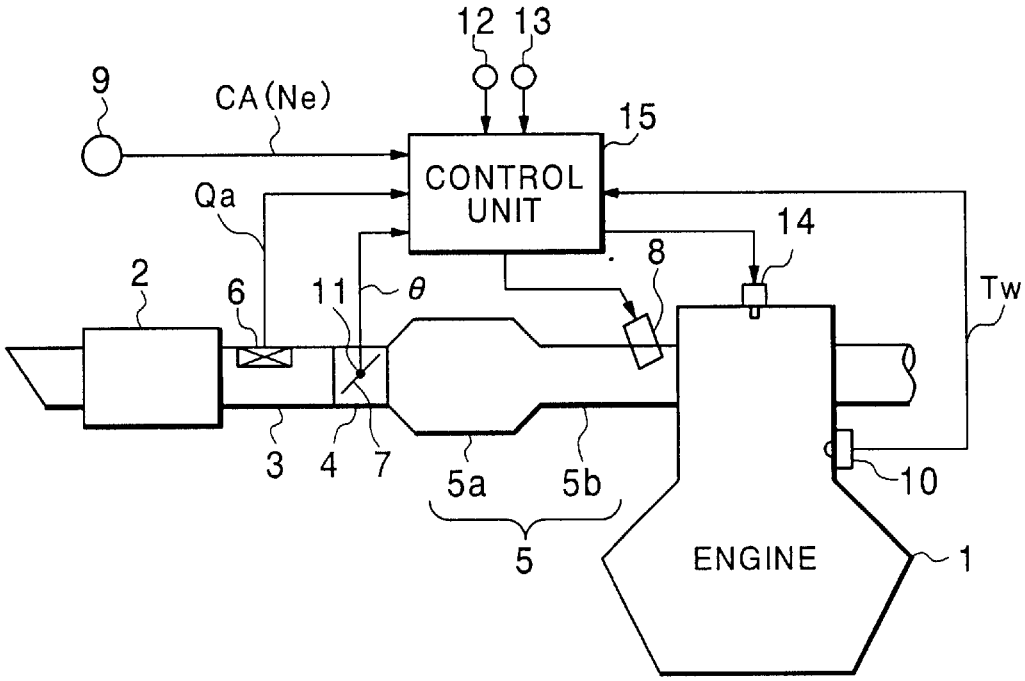
FIG. 1 is a block diagram showing schematically and generally a structure of an internal combustion engine system equipped with an engine starting control apparatus according to a first embodiment of the invention.

The present invention will be described in detail in conjunction with what is presently considered as preferred or typical embodiments thereof by reference to the drawings. In the following description, like reference characters designate like or corresponding parts throughout the several views.

Embodiment 1

Now, referring to drawings, description will be made in detail of a starting control apparatus for an internal combustion engine according to a first embodiment of the present invention.

FIG. 1 is a block diagram showing schematically and generally a structure of an internal combustion engine system according to the first embodiment of the invention and shows an internal combustion engine and an intake air flow rate detecting apparatus together with a control system therefor.

Referring to FIG. 1, air is sucked into an internal combustion engine (hereinafter also referred to simply as the engine) 1 by way of an intake pipe. An exhaust gas resulting from the combustion within the cylinders of the engine 1 is discharged to the atmosphere through an exhaust pipe.

An air cleaner 2 is installed on the intake pipe at an upstream location thereof.

The intake pipe is composed of an intake air duct 3, a throttle chamber 4 and an intake manifold 5. The air sucked through the air cleaner 2 is supplied to the cylinders of the engine 1 by way of the intake air duct 3, the throttle chamber 4 and the intake manifold 5, respectively.

An air flow meter 6 is installed within the intake air duct 3 for detecting a flow rate of the intake air (also referred to as the intake air flow rate) Qa.

Further, disposed within the throttle chamber 4 is a throttle valve 7 which is linked to an accelerator pedal (not shown) or alternatively is actuated by a throttle actuator (not shown either) to thereby control the flow rate or quantity Qa of the intake air fed to the engine 1.

The intake manifold 5 disposed downstream of the throttle valve 7 is constituted by a surge tank 5*a* and intake pipe sections 5*b* which are branched into the individual engine cylinders, respectively, at the side downstream of the surge tank 5*a*.

An electromagnetic type fuel injection valve 8 is mounted on each of the intake pipe sections 5*b* of the intake manifold 5. A fuel pump (not shown) and a pressure regulator (not shown either) are installed in association with the fuel injection valve 8.

The fuel injection valve 8 serves for injecting into the intake pipe section 5*b* a quantity of the fuel which is fed under pressurization from the fuel pump and regulated to a predetermined pressure by the pressure regulator.

A crank angle sensor 9 is mounted on a crank shaft (not shown) of the engine 1, which sensor is designed to output a crank angle signal CA indicative of an engine rotation number or speed (rpm) Ne.

It should further be added that the crank angle sensor 9 also serves as a rotation sensor for detecting the rotation of the engine 1.

More specifically, the crank angle sensor 9 is so designed as to output reference signals (at least one of which serves as a cylinder identification signal) at every predetermined crank angle position corresponding to specific strokes of the individual cylinders while outputting a unitary crank angle signal for every unitary crank angle (e.g. of 1° to 2°, 10° to 20°, 10° to 30°).

The engine 1 is provided with a water temperature sensor 10 for detecting a cooling water temperature Tw of the engine. On the other hand, the throttle valve 7 is provided with a throttle position sensor 11 for detecting an opening degree θ of the throttle valve 7.

Operatively coupled to the crank shaft of the engine 1 is a starter (e.g. electric starter motor) 12 which serves as a cranking means. On the other hand, a key manipulation unit (not shown) is provided with a starter switch 13 for starting operation of the starter 12 and others.

Furthermore, in a combustion chamber defined within each cylinder of the engine 1, a spark plug 14 is installed for igniting the air-fuel mixture charged through the intake pipe section 5*b* at a predetermined timing.

The detection signals Qa, CA, Tw and θ outputted from the various types of sensor means 6, 9 to 11 mentioned above are inputted to an electronic control unit 15 in which a microcomputer or microprocessor is incorporated.

The control unit 15 is designed to measure the output period of the reference signal contained in the crank angle signal CA or the input period of the crank angle signal CA to thereby detect the engine rotation speed (engine rotation number) Ne.

Further, the control unit 15 is so designed as to perform the fuel injection control and the ignition control for thereby controlling the operation of the engine in the starting phase thereof by driving appropriately the fuel injection valves 8 and the spark plugs 14 in dependence on the engine rotation speed (rpm) Ne derived from the crank angle signal CA and the engine operation state determined on the basis of the other detection signals Qa, Tw, θ, etc.

Next, referring to a flow chart shown in FIG. 2, description will be made of processings involved in the starting control procedure for the engine system according to the first embodiment of the invention, which system is shown in FIG. 1. Parenthetically, the engine starting control routine shown in FIG. 2 is executed by an engine starting control means (module) incorporated in the control unit 15.

Figure 2:
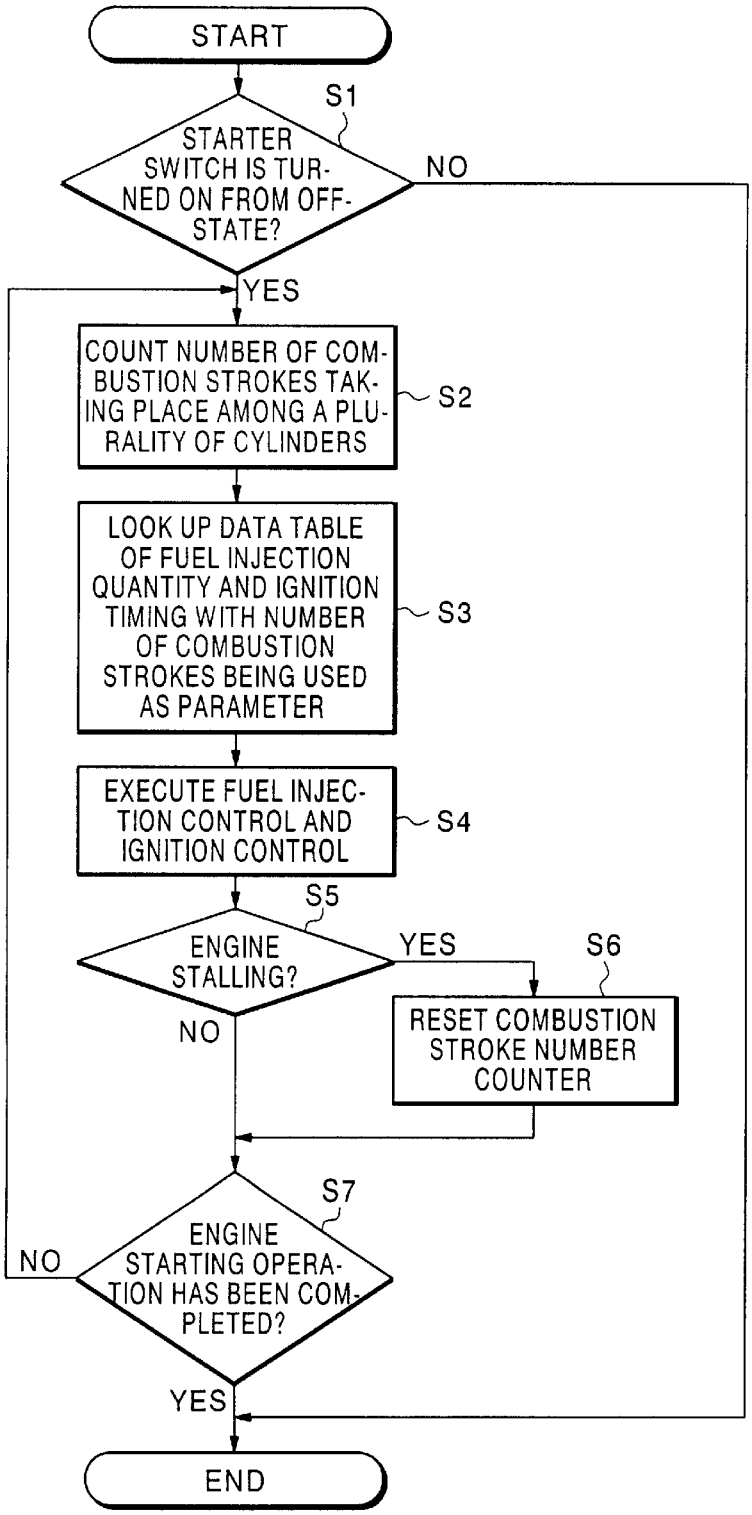
FIG. 2 is a flow chart for illustrating an engine starting control routine for the engine system according to the first embodiment of the invention.

Referring to FIG. 2, decision is first made as to whether the starter switch 13 is turned on from the off-state (step S1). Unless the starter switch 13 is turned on (i.e., when the decision step S1 results in negation "NO"), the processing routine shown in FIG. 2 is immediately terminated.

On the other hand, when it is decided in the step S1 that the starter switch 13 is turned on from the off-state (i.e., when the decision step S1 results in affirmation "YES"), the number of the combustion strokes taking place among a plurality of cylinders of the engine 1 is counted (step S2), whereon the fuel injection quantity and the ignition timing are determined in dependence on the number of the combustion strokes by looking up a data table (step S3).

Subsequently, in a step S4, the fuel injection control and the ignition control are carried out for the cylinder currently subjected to the control in conformance with the fuel injection quantity and the ignition timing determined in the step S3.

In succession, decision is made in a step S5 whether or not the engine 1 is stalling by deciding whether or not the engine rotation number (rpm) Ne is smaller than a predetermined value and whether or not this stalling state has continued for a predetermined time since the starting of the engine operation.

When it is decided in the step S5 that the engine stall event occurs (i.e., when the step S5 results in "YES"), the counter for counting the number of the combustion strokes is cleared to zero (i.e., reset) in a step S6, whereupon the processing proceeds to a step S7. On the contrary, when it is decided in the step S5 that no stall event takes place (i.e., when the step S5 is "NO"), the processing immediately proceeds to a step S7.

Finally, decision is made in the step S7 whether or not the starting operation for the engine 1 has been completed (i.e., whether or not the complete explosion has occurred) by deciding whether or not the engine rotation number (rpm) Ne is equal to or greater than the predetermined value and whether or not this state has continued for a predetermined time after the engine has been started.

When it is decided in the step S7 that the starting operation has been completed (i.e., when the decision step S7 results in "YES"), the processing routine shown in FIG. 2 comes to an end, whereon the processing makes transition to a control procedure for sustaining the operating state of the engine.

In other words, the engine starting control is terminated, whereon the fuel injection control and the ignition control are carried out for driving the engine in the ordinary operation state.

On other hand, when it is decided in the step S7 that the starting operation has not been completed (i.e., the decision step S7 results in "NO"), the step S2 is resumed, whereon the engine starting control sequence described above is executed repetitively.

Parenthetically, the data tables looked up for determining the fuel injection quantity and the ignition timing in the step S3 described above may be prepared in such forms as illustrated in FIGS. 3 and 4, respectively.

The map data shown in FIGS. 3 and 4 are previously stored in a read-only memory or ROM (not shown) which is incorporated in the control unit 15.

As can be seen in FIG. 3, the fuel injection quantity [mcc] is so set as to increase gradually from an initial value (200 [mcc]) to a maximum value (250 [mcc]) as the counter value CNT of the combustion stroke number increases.

Further, as is shown in FIG. 4, the ignition timing (BTDC [° CA]) is so set as to advance from an initial value (25°) to a maximum advanced position (28°) as the counter value CNT of the combustion stroke number increases in the range where the counter value CNT is small whereas the ignition timing is retarded to a maximum retarded position (15°) as the counter value CNT of the combustion stroke number increases in the range where the counter value CNT is large.

Accordingly, in the step S4 shown in FIG. 2, the fuel injection control and the ignition control are carried out on the basis of the fuel injection quantity and the ignition timing selected in dependence on the counter value CNT of the combustion stroke number, as illustrated in FIGS. 3 and 4.

In this way, the fuel injection quantity and the ignition timing are set such that optimal combination thereof can be realized in conformance with the counter value CNT of the combustion strokes taking place sequentially among the plurality of cylinders from the initiation of the cranking operation. Thus, the complete explosion state can speedily be brought about, and then the starting operation for the engine 1 is completed.

Parenthetically, in the case of the numerical example illustrated in FIG. 3, the fuel injection quantity [mcc] is gradually increased as the counter value CNT of the combustion stroke number increases. It should however be appreciated that the map data value shown in FIG. 3 may be variably set such that the fuel injection quantity [mcc] will gradually decrease in consideration of the inherent characteristics of the engine 1.

Similarly, the ignition timing (BTDC [° CA]) is never restricted to the values shown in FIG. 4. The map data value for the ignition timing may variably be so set that the ignition timing [BTDC [° CA]) increases or decreases properly as the counter value CNT of the combustion stroke number increases by taking into account the inherent characteristics of the engine 1.

Figure 5:
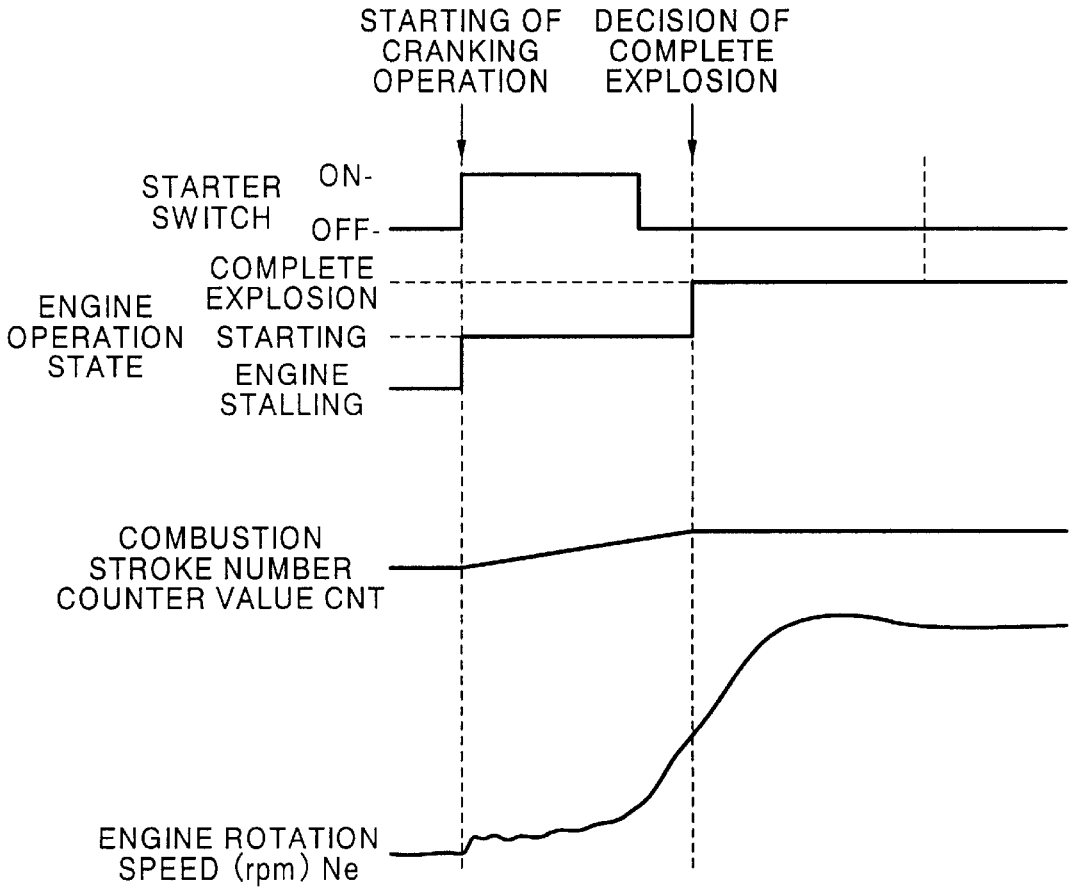
FIG. 5 is a timing chart for illustrating graphically a normal engine starting operation achieved with the engine starting control apparatus according to the first embodiment of the invention.

FIG. 5 is a timing chart for illustrating a normal engine starting operation which can be realized with the engine starting control apparatus according to the first embodiment of the invention.

In FIG. 5, there are shown time-dependent changes of the counter value CNT of the combustion stroke number and the engine rotation number (rpm) Ne, respectively, in dependence on the on/off state of the starter switch 13 and the operation state of the engine 1.

Figure 6:
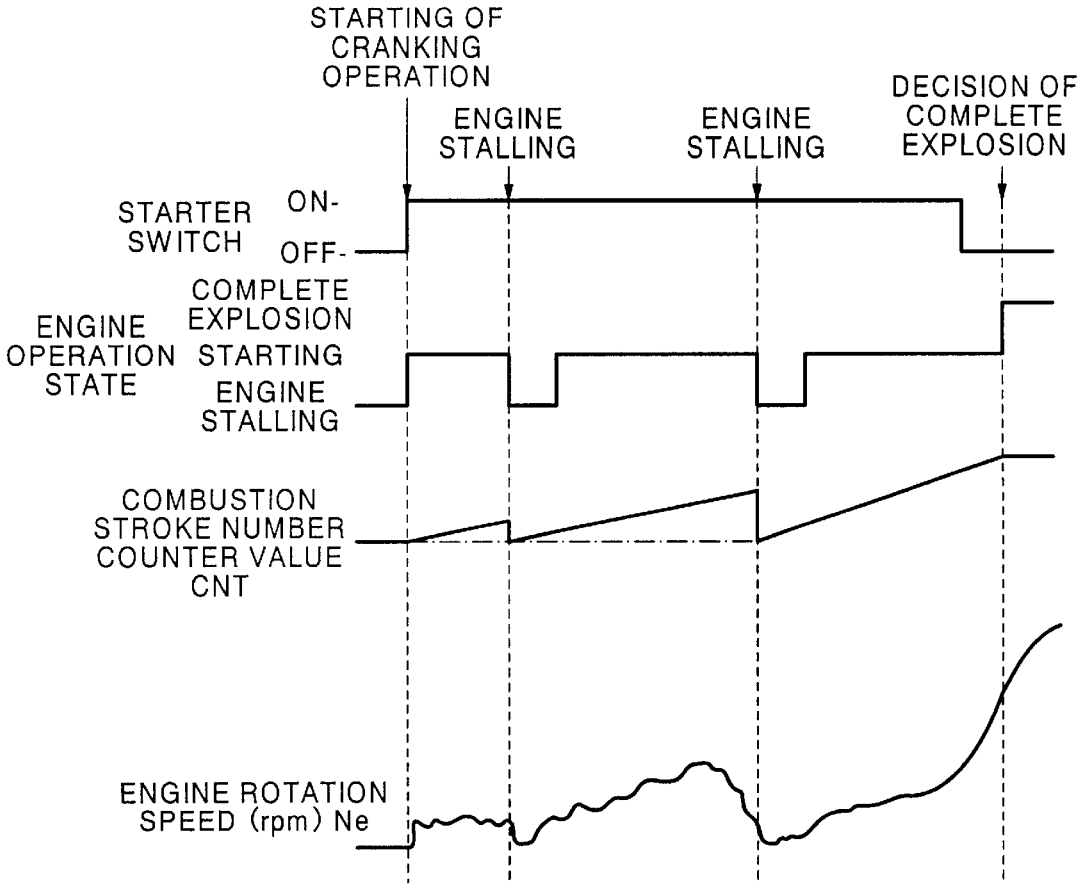
FIG. 6 is a timing chart for illustrating graphically an engine starting operation state in which engine stall event takes place repetitionally.

On the other hand, FIG. 6 shows in a timing chart the engine starting operation upon occurrence of the engine stall event upon the control with the apparatus according to the instant embodiment of the invention. More specifically, there is shown in FIG. 6 the state which brings about the engine stall event in the course of the engine starting operation, as described hereinbefore in conjunction with the step S5 shown in FIG. 2.

As can be seen in FIG. 6, every time decision is made that the engine stall event occurs due to lowering of the engine rotation speed Ne, the counter value CNT of the combustion stroke number is reset (step S6 shown in FIG. 2). As a result of this, the control quantities based on the map data are selected with the engine rotation number (rpm) Ne changing repetitionally until the complete explosion takes place.

More specifically, combination of the fuel injection quantity and the ignition timing after the decision of occurrence of the engine stall event is sequentially set, starting from the initial values of the fuel injection quantity and the ignition timing, in conformance with the data value shown in FIGS. 3 and 4 as a function of the counter value CNT.

In this way, during the period extending from the start of the cranking operation up to the occurrence of the complete explosion in the engine starting phase, the fuel injection quantity charged to the individual cylinders on a cylinder-by-cylinder basis and the ignition timing for burning the fuel can optimally be combined in the individual combustion strokes taking place sequentially among the plurality of cylinders, whereby the torque as required can be produced just enough in the individual combustion strokes.

Thus, the favorable starting performance can be realized with the fuel injection quantity corresponding to a lean air-fuel ratio, i.e., with a relatively low fuel concentration of the air-fuel mixture, while HC discharge quantity upon starting operation of the engine can be reduced, to the advantageous effect.

Embodiment 2

In the case of the starting control apparatus according to the first embodiment of the invention, the map data shown in FIGS. 3 and 4 are definitely determined on the basis of the counter value CNT of the combustion stroke number. However, these control quantities may also be set to different values upon every restarting after occurrence of the engine stall event or alternatively optimal combination of the fuel injection quantity and the ignition timing may be set in dependence on the other engine operation state(s).

Figures 7, 8:
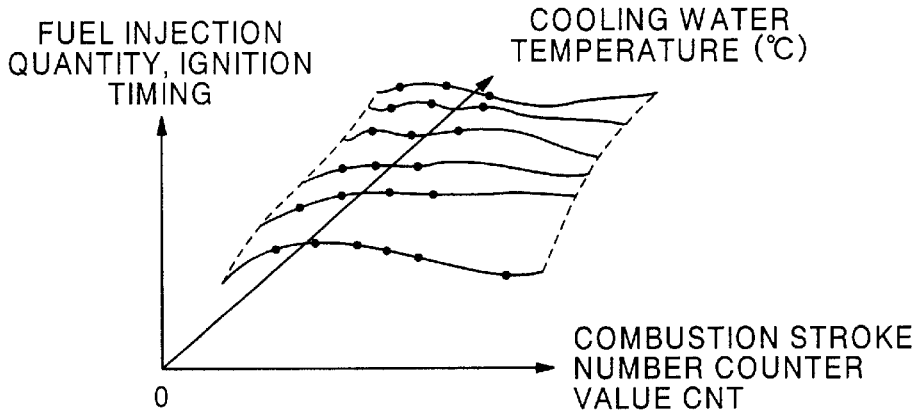
FIG. 7 is a view for graphically illustrating map data to be looked up for determining the fuel injection quantity and the ignition timing as a function of combustion stroke number while taking into account temperature of the engine according to a second embodiment of the present invention.
FIG. 8 is a view showing a map data table of an ignition timing correcting quantity employed in the control apparatus according to a third embodiment of the present invention.

FIG. 7 is a view for graphically illustrating three-dimensional map data looked up for determining the control quantities in consideration of other operation state of the engine in the engine starting control apparatus according to a second embodiment of the present invention.

More specifically, FIG. 7 illustrates selective determination of the fuel injection quantity and the ignition timing as a function of the counter value CNT of the combustion stroke number while taking into account the cooling water temperature Tw.

As can be seen in FIG. 7, by looking up the fuel injection quantity data and the ignition timing data in the three-dimensional table as a function of the counter value CNT of the combustion stroke number while considering the cooling water temperature Tw of the engine 1 which is detected by, e.g. the water temperature sensor 10, the fuel injection quantity and the ignition timing can be set up optimally. The look-up of the table shown in FIG. 7 is performed in the step S3 shown in FIG. 2.

By setting up the fuel injection quantity and the ignition timing on the basis of the number CNT of the combustion strokes and the cooling water temperature Tw so that the optimal combination of these control quantities can be realized, as described above, torque of desired magnitude can be generated with higher accuracy in the individual combustion strokes, respectively, whereby not only the improved starting performance can be realized but also reduction of the HC discharge quantity can satisfactorily be achieved in the engine starting phase. Besides, the operation of the engine can speedily be started.

Embodiment 3

In the case of the starting control apparatuses described above in conjunction with the first and second embodiments of the invention, the engine rotation number (rpm) Ne is not taken into consideration upon selection of the control quantity (ignition timing). It is however to be noted that the data table look-up may equally be adopted for determining the ignition timing correcting quantity in dependence on e.g. the rate of change ΔNe of the engine rotation number (rpm) Ne.

The ignition timing can be set up on the basis of the counter value CNT of the combustion stroke number as described hereinbefore by reference to FIG. 4 or FIG. 7. However, in the case where the combustion states taking place sequentially among the plural cylinders differ from one to another in dependence on the engine rotation number Ne, it is desirable to correct the ignition timing by taking into account the engine rotation number (rpm) Ne to thereby selectively set up further optimized fuel injection quantity and ignition timing.

FIG. 8 is a view showing a map data table which is looked up for selecting the ignition timing correcting quantity in dependence on the rate of change ΔNe of the engine rotation number in the control apparatus according to a third embodiment of the present invention.

In the map data table shown in FIG. 8, the ignition timing correcting quantity [° CA] for correctively retarding the ignition timing over a range from an initial value "0" to "+10" are selectively determined as a function of the rate of change ΔNe [r/min] of the combustion stroke number.

In this conjunction, it is to be mentioned that the ignition timing correcting quantity is selected on the basis of the rate of change ΔNe (=Ne−Ne(t−1)) which is determined as a difference between the engine rotation number Ne(t) in the current combustion stroke and the engine rotation number Ne(t−1) in the preceding combustion stroke.

More specifically, according to the teaching of the present invention incarnated in the instant embodiment thereof, the control unit 15 (see FIG. 1) is so designed or programmed as to arithmetically determine the rate of change ΔNe of the engine rotation number for each of the combustion strokes taking place sequentially among the a plurality of cylinders to thereby read out the ignition timing correcting quantity from the map data table shown in FIG. 8 with the rate of change ΔNe of the engine rotation number being used as the parameter.

Parenthetically, the ignition timing correcting quantities [° CA] are not restricted to the set values shown in FIG. 8 but may be greater or smaller as desired in dependence on the rates of changes ΔNe [r/min] of the engine rotation number in consideration of the inherent characteristics of the engine 1.

In the current combustion stroke, the reference value of the ignition timing determined by referencing the map data table shown in FIG. 4 or FIG. 7 is correctively added with the ignition timing correcting quantity determined by referencing the table shown in FIG. 8, to thereby determine the final ignition timing.

Subsequently, in the step S4 shown in FIG. 2, the ignition control is carried out on the basis of the corrected ignition timing.

In this manner, by correcting the reference value of the ignition timing by taking into account the engine rotation number (rpm) Ne, favorable starting performance can be realized with the fuel injection quantity of lean air-fuel ratio with the HC discharge quantity being significantly reduced in the engine starting phase.

Although the foregoing description has been made on the presumption that the rate of change ΔNe of the engine rotation number is made use of as the parameter for selecting the ignition timing correcting quantity from the look-up data table shown in FIG. 8 for the current combustion stroke, it should be mentioned that the absolute value of the engine rotation number (rpm) Ne may equally be used in place of the rate of change ΔNe.

Furthermore, although the final ignition timing is determined through corrective addition or subtraction of the ignition timing correcting quantity to or from the ignition timing determined through table look-up of the map data table shown in FIG. 4 or FIG. 7, it goes without saying that the final ignition timing can also be determined through corrective multiplication (or division) of the ignition timing reference value by the ignition timing correcting coefficient selected in dependence on the rate of change ΔNe of the engine rotation number (rpm).

Many modifications and variations of the present invention are possible in the light of the above techniques. It is therefore to be understood that within the scope of the appended claims, the invention may be practiced otherwise than as specifically described.

What is claimed is:

1. A starting control apparatus for an internal combustion engine, comprising:

an intake pipe for supplying an air-fuel mixture containing air and a fuel to said internal combustion engine which includes a plurality of cylinders;

a throttle valve mounted internally of said intake pipe for adjusting flow rate of intake air fed to said internal combustion engine;

a fuel injection valve for charging the fuel into the cylinder of said internal combustion engine;

a spark plug provided in association with each of said plural cylinders of said internal combustion engine for igniting the air-fuel mixture charged into said cylinder;

various types of sensors for detecting operating state of said internal combustion engine; and a control unit for controlling said fuel injection valve and said spark plug in dependence on the operating state of said internal combustion engine upon starting of operation of said internal combustion engine, said control unit comprising:

combustion stroke discriminating means for discriminatively identifying combustion strokes taking place sequentially among said plural cylinders, wherein the fuel injection quantity supplied to the individual cylinders of said internal combustion engine and the ignition timing for burning the charged fuel are set variably for said individual combustion strokes, respectively, upon starting of operation of said internal combustion engine.

2. A starting control apparatus for an internal combustion engine according to claim 1, wherein said control unit includes:

a counter for counting the number of the combustion strokes taking place sequentially among said plurality of cylinders from a time point at which cranking is started upon starting of operation of said internal combustion engine, wherein said fuel injection quantity and said ignition timing for each of said cylinders are set on the basis of said number of said combustion strokes.

3. A starting control apparatus for an internal combustion engine according to claim 2, wherein said control unit includes:

a storage for storing control quantity map data bearing correspondency to said fuel injection quantity and said ignition timing, respectively, with said number of said combustion strokes being used as parameter with a view to setting said fuel injection quantity and said ignition timing by looking up said control quantity map data, and wherein the map data value for said fuel injection quantity is set variably so that said control quantity increases or alternatively decreases in dependence on increase of the number of said combustion strokes.

4. A starting control apparatus for an internal combustion engine according to claim 1, said various types of sensors including a water temperature sensor for detecting cooling water temperature of said internal combustion engine, wherein said control unit is so designed as to set said fuel injection quantity and said ignition timing on the basis of said cooling water temperature.

5. A starting control apparatus for an internal combustion engine according to claim 1, said various types of sensors including a rotation sensor for detecting a rotation number (rpm) of said internal combustion engine, wherein said control unit is so designed as to set a correcting quantity for said ignition timing in dependence on the rotation number of said internal combustion engine.

6. A starting control apparatus for an internal combustion engine according to claim 5, said control unit including a storage for storing correcting quantity map data bearing correspondency to the control quantity for said ignition timing as a function of change of rotation number of said internal combustion engine, wherein said control unit is so designed as to set a correcting quantity for said ignition timing by looking up said correcting quantity map data to thereby set finally the ignition timing determined by adding or subtracting said correcting quantity to or from a reference value of said ignition timing.

* * * * *